US006241335B1

(12) United States Patent
Suzuki

(10) Patent No.: US 6,241,335 B1
(45) Date of Patent: Jun. 5, 2001

(54) METHOD OF PRODUCING INK JET RECORDING HEAD AND INK JET RECORDING HEAD PRODUCED BY THE METHOD

(75) Inventor: Toshio Suzuki, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/218,419

(22) Filed: Dec. 22, 1998

(30) Foreign Application Priority Data

Dec. 24, 1997 (JP) ..... 9-355340
Dec. 25, 1997 (JP) ..... 9-358096

(51) Int. Cl.[7] ..... B41J 2/015

(52) U.S. Cl. ..... 347/20; 347/63; 347/65; 29/890.1

(58) Field of Search ..... 347/96, 20, 77, 347/71, 44, 63, 65; 29/890.1

(56) References Cited

U.S. PATENT DOCUMENTS 4,450,455 5/1984 Sugitani et al. ..... 346/140 R
4,558,333 12/1985 Sugitani et al. ..... 346/140 R
5,030,317 7/1991 Noguchi ..... 156/630
5,332,466 * 7/1994 Nozawa ..... 347/63
5,924,197 * 7/1999 Murakami et al. ..... 347/20
6,041,501 * 3/2000 Suzuki et al. ..... 347/65

FOREIGN PATENT DOCUMENTS 60-203451 10/1985 (JP) .
4-191052 7/1992 (JP) .
8-156273 6/1996 (JP) .
9-29980 2/1997 (JP) .

* cited by examiner

*Primary Examiner*—John Barlow
*Assistant Examiner*—M. Shah
(74) *Attorney, Agent, or Firm*—Fitzpatrick, Cella, Harper & Scinto

(57) ABSTRACT

A method of producing an ink jet recording head including a solid layer forming step of forming a solid layer in a pattern on a portion of a substrate, which portion is communicated with a discharge port, which discharges ink, and corresponds to an ink path provided with an energy generator which generates energy which is utilized for discharging ink from said discharge port; a wall member providing step of providing a non-cured material for forming a wall member of said ink path on a top plate so that the non-cured material is held with a surface tension at a side end of said top plate; an approaching step of allowing said substrate and said top plate to approach each other so that said non-cured material covers said solid layer; and a solid layer removing step of removing said solid layer to form said ink path.

13 Claims, 9 Drawing Sheets

METHOD OF PRODUCING INK JET RECORDING HEAD AND INK JET RECORDING HEAD PRODUCED BY THE METHOD

BACKGROUND OF THE INVENTION

1. Field of the Invention

The present invention relates to a method of producing an ink jet recording head that discharges ink to record and an ink jet recording head produced by the method.

2. Related Background Art

An ink jet recording device is integrally or separately provided as an output terminal of an information processing apparatus such as a word processor, computer, and the like, and also, the ink jet recording device is widely used in a copy machine combined with an information reading device or the like, a facsimile apparatus having an information transmitting and receiving function, a printing machine for printing a character etc. to a cloth, and the like. This ink jet recording device has a feature that a high-definition image can be recorded at a high speed by discharging ink from a discharge port as fine droplets.

Particularly, a type of an ink jet recording device that uses an electrothermal converting member as an energy generator which generates energy which is utilized for discharging ink, and discharges ink by utilizing the ink bubbling generated with the thermal energy which is generated by the electrothermal converting member is suitable for high-definition properties of images, high speed recording properties, miniaturization of the recording head and device, and also coloring of images. Therefore, such type ink jet recording device have been recently noted.

An ink jet recording head which is used in an in jet recording device is usually provided with a plurality of discharge ports. The ink jet recording head is hereinafter referred to as merely a "head". Each electrothermal converting member, which generates thermal energy, which is utilized for discharging ink respectively from the discharge ports, is provided on a substrate, with the electrothermal converting member corresponding to each of ink paths. The electrothermal converting member is mainly constructed with exothermic resistors, electrode wiring for supplying the resistors with electric power, and insulating protective films.

The head often has a basic structure connected a substrate provided with electrothermal converting members to an ink paths-formed top plate. In each ink flow path included in the ink path, the discharge port and the opposite end are communicated with a common ink chamber. In this common ink chamber is stored ink which is supplied from an ink tank. A plurality of ink flow paths and the common ink chamber will be integrally referred to as an "ink path" later.

Ink supplied to the common ink chamber is led to each of the ink flow paths and held near the discharge port while forming a meniscus. Thermal energy generated is utilized by selectively driving an electrothermal converting member at this state, to heat rapidly ink on a heat surface to boil it. After that, the ink is discharged from the discharge port.

One conventional example of methods of producing such head is described in U.S. Pat. No. 5,030,317. FIGS. 1A to 1F are schematic perspective views for explaining the steps of the method. As shown in FIG. 1A, on an ink path formation portion on a substrate 21 provided with electrothermal converting members 27 each respectively arranged so as to correspond an ink path, is provided a solid layer 28 made of a resin having, for example, a positive type photosensitive property. Then, as shown in FIG. 1B, on thus obtained structure is formed a layer made of a material to be set or cured with an active energy line, which material will be an ink path wall forming member 22. Then, as shown in FIG. 1C, on the obtained structure is laminated a top plate 24 provided with a recess 29 communicated with an ink supply port 26. After that, as shown in FIG. 1D, a photo-mask 32 is provided on a portion which corresponds to a common ink chamber, an active energy line is irradiated in the arrow direction, and a portion of the material to be set with an active energy line is set. Then, as shown in FIG. 1E, a solid layer removing liquid is introduced in a direction shown with arrows therein, from the ink supply port 26 and the like, to remove the solid layer 28. Thus, as shown in FIG. 1F, an ink path which is communicated with a discharge port 33.

However, by such method, a variance of connecting strength between the layer made of the material set with the active energy line, which will be the ink path forming member 22, and the top plate is generated. Thus, a slight gap therebetween is formed and ink is leaked therefrom, and further, the strength and durability of the head itself are deteriorated.

SUMMARY OF THE INVENTION

One object of the present invention is to provide a method of producing an ink jet recording head, by which a high-definition ink jet recording head having its enhanced strength and durability, can be efficiently and easily produced.

Another object of the present invention is to provide a method of producing an ink jet recording head comprising:

- a solid layer forming step of forming a solid layer in a pattern on a portion of a substrate, which portion is communicated with a discharge port, which discharges ink, and corresponds to an ink path provided with an energy generator which generates energy which is utilized for discharging ink from said discharge port;
- a wall member providing step of providing a non-cured material for forming a wall member of said ink path on a top plate so that the wall member is held with a surface tension at a side end of said top plate;
- an approaching step of allowing said substrate and said top plate to approach each other so that said non-cured material covers said solid layer; and
- a solid layer removing step of removing said solid layer to form said ink path.

Still another object of the present invention is to provide a high-definition ink jet recording head having its enhanced strength and durability, produced by such a production method.

According to the present invention, since a non-cured material for forming the wall member of the ink path is provided on a top plate, an ink jet recording head having its enhanced strength and durability and the connecting strength between the wall member and the top plate, can be produced. Further, since the non-cured material is held with a surface tension at a side end of said top plate, the wall member of the ink path, having a relatively large and desired thickness, can be easily formed at a desired position. Additionally, if the top plate which is thinner at a portion corresponding to a plurality of ink paths than other portions is used, it is preferably possible to decrease a spacer for forming a space in which the material for forming the wall member of the ink path is filled.

DETAILED DESCRIPTION OF THE INVENTION

Preferred embodiments of the present invention will be described in detail with reference to drawings. However, the present invention is not limited thereto, but can be appropriately modified within the scope of claims.

EXAMPLE 1

FIGS. 2A to 2G are schematic cross-sectional views showing a production process steps of an ink jet recording head according to Example 1 of present invention.

Figure 1A:
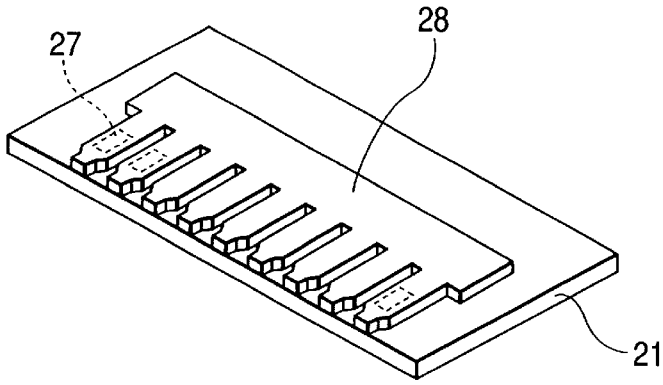
FIG. 1A PRIOR ART
FIGS. 1A, 1B, 1C, 1D, 1E, and 1F are schematic perspective views for explaining one conventional example of a method of producing an ink jet recording head.
Figure 1B:
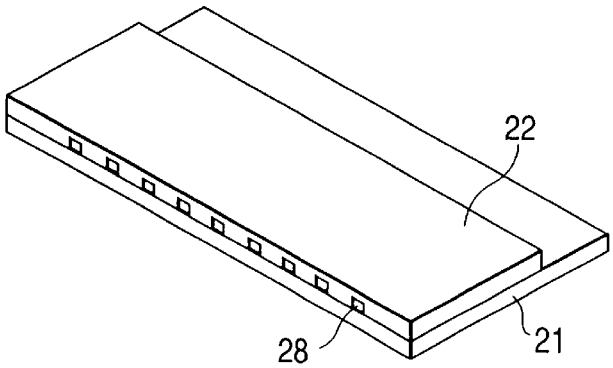
FIG. 1B PRIOR ART
Figure 1C:
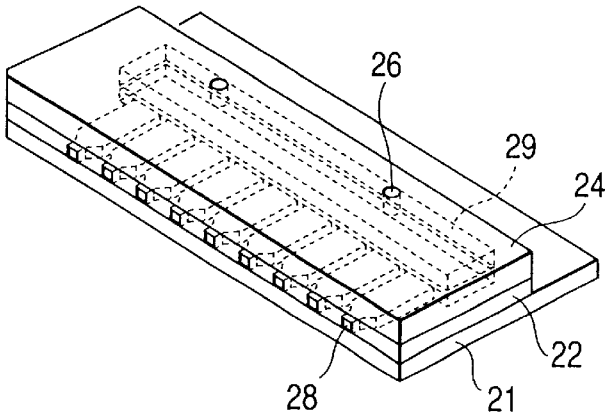
FIG. 1C PRIOR ART
Figure 1D:
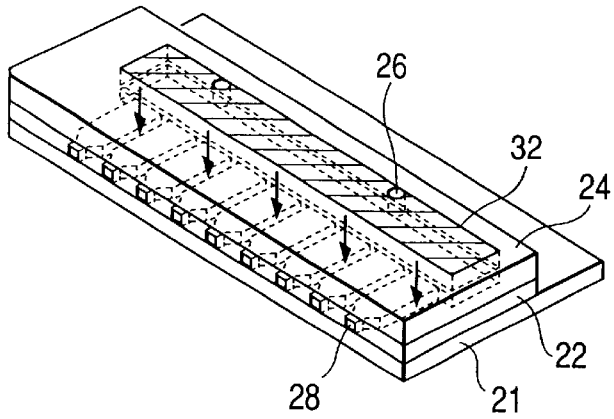
FIG. 1D PRIOR ART
Figure 1E:
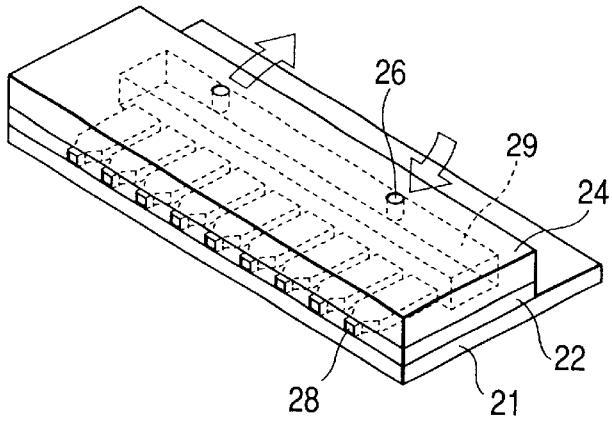
FIG. 1E PRIOR ART
Figure 1F:
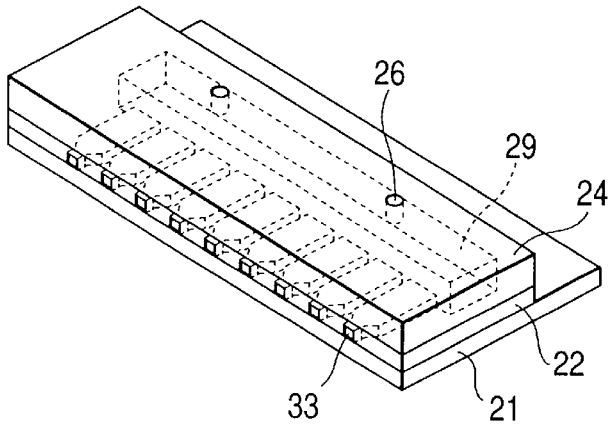
FIG. 1F PRIOR ART
Figure 2A:
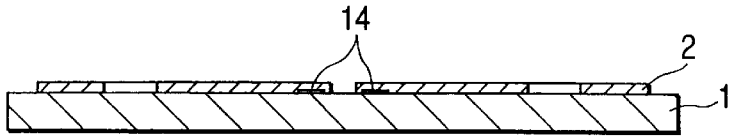
FIGS. 2A, 2B, 2C, 2D, 2E, 2F and 2G are schematic cross-sectional views showing a production process steps of an ink jet recording head according to Example 1 of present invention, and showing in turn the process steps from FIG. 1A.

Referring to FIG. 2A, a first solid layer 2 having a thickness of 20 $\mu$m was formed on an ink path formation portion on a 2 mm thick aluminum substrate provided with two rose of electrothermal converting members 14, which generate thermal energy, which acts an energy for discharging ink. The solid layer 2 is removed after the completion of each of steps which will be described later, and the left space portion forms an ink path. As the solid layer a material "MF-58" produced by TOKYO OUKA.

Figure 2B:
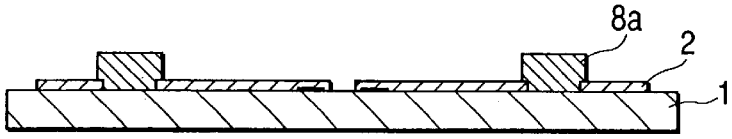

Referring to FIG. 2B, to form an adhesive layer, a cold setting resin 8*a* was applied to a portion where the solid layer 2 is not formed on the substrate 1, with a dispenser. As the cold setting resin 8*a,* a final mixture mixed with a mixture of 100 parts by weight of "EPIKOTE 828" produced by Yuka Shell Epoxy Co. Ltd, and 50 parts by weight of "FUJICURE-6010" produced by Fuji Kasei Kogyo Co. Ltd., and a 30% filler by weight was used. The final mixture was applied to the above-mentioned portion by the use of a needle of G19, under conditions of a discharge pressure of 0.8 kg/cm$^2$, coating speed of 30 mm/sec, and distance between the substrate and the needle of 0.3 mm. Further, the resin 8*a* on the substrate 1 was heated at a temperature of 75° C., for 1 hour with an oven to obtain a half-set cold setting resin 8*a*.

Figure 2C:
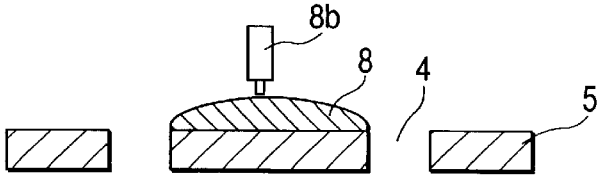

Referring to FIG. 2C, as a top plate 5, a 2 mm thick aluminum plate having a supply opening 4 and subjected to ink resisting processing was used. A cold setting resin 8, which will be the wall member of the ink path, was applied to the center portion of the top plate 5 having a width of 2.0 mm from a dispenser 8*b,* with the surface of the top plate 5 directed upwardly. This cold setting resin 8 was obtained by removing a filler from the above-mentioned cold setting resin 8*a*. This cold setting resin 8 was coated by a needle G21 with a discharge pressure 3.0 Kg/cm$^2$, coating speed 30 mm/sec and distance 0.2 mm between the top plate and the needle. Although the cold setting resin 8 has no filler, it is held in a convex shape and with a relatively large thickness by the surface tension at the side end of the top plate. The resin 8 was left at normal temperature, for 1 hour under vacuum.

Heating in FIG. 2B is performed at the atmospheric pressure. On the other hand, lefting in FIG. 2C is performed under vacuum or at a reduced pressure. The reason of the different condition is as follows. Namely, since the adhesive layer is used to connect the substrate 1 to the top plate 5, there arises no problem so much even if the cold setting resin 8*a* has some bubbles. On the other hand, since the cold setting resin 8 in FIG. 2C directly contacts the solid layer, which will define a fine ink path later, a presence of bubbles in the resin 8 can change the shape of the ink flow path and connect the plurality of discharge ports to each other. Accordingly, a debubbling process is carried out under vacuum in FIG. 2C. In this step in FIG. 2C, the vacuum condition may be used from the stage of the application of the resin 8.

Although it was explained that the step of FIG. 2C is carried out after the steps of FIGS. 2A and 2B, the step of FIG. 2C may be carried out before or simultaneously with the steps of FIGS. 2A and 2B.

Figure 2D:
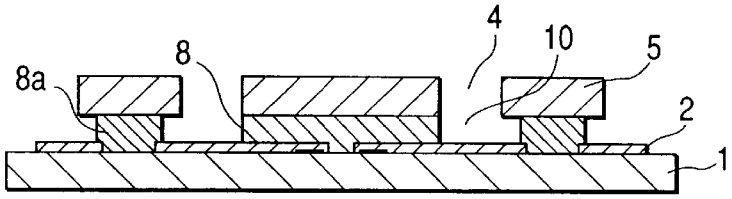

Referring to FIG. 2D, the top plate 5 was connected to the substrate 1, with the surface of the top plate 5 directed downwardly. In this connection, since the resin 8 is in a non-cured condition, both the top plate 5 and the substrate 1 can be connected to each other at a comparatively small pressure. In this process, no common chamber 10 is filled with resin. However, if the resin enters the common chamber, it may be cut to the solid layer 2 as shown in FIG. 7E. After that a full setting or setting processing of the resin 8 was performed at 30° C. for 24 hours and at 120° C. for 1 hour.

Figure 3A:
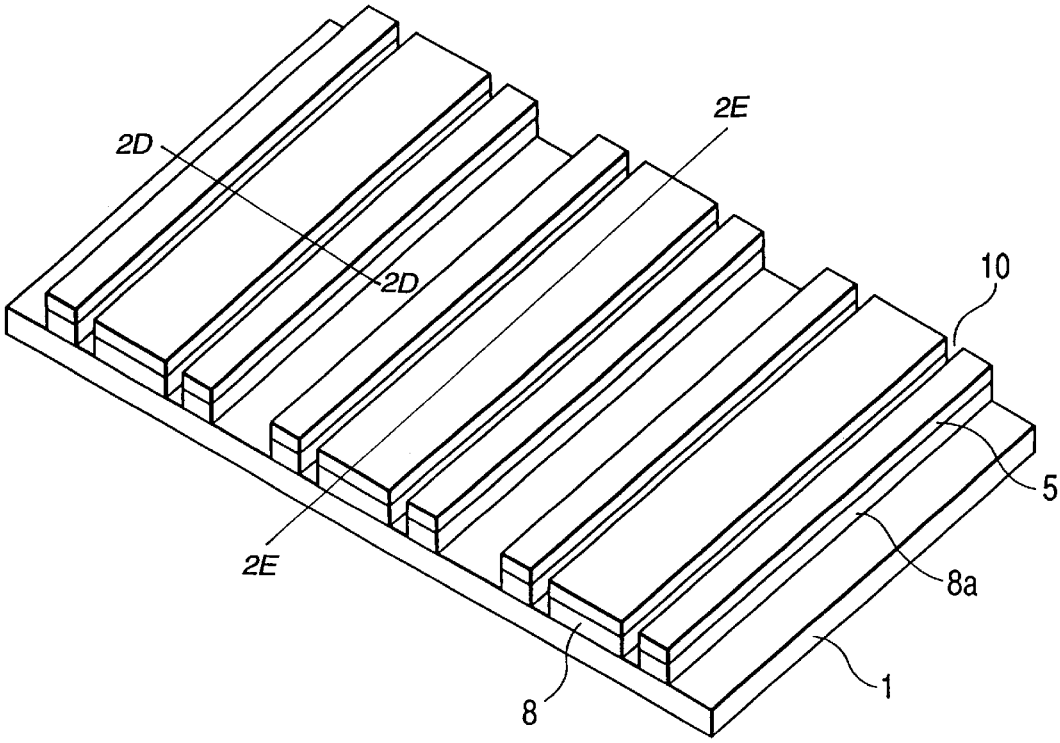
FIGS. 3A and 3B are schematic perspective views showing an ink jet recording head during the production thereof, which corresponds to a part of FIGS. 2A to 2G.

The ink jet recording head during the production thereof, which corresponds to the head in the present step of FIG. 2D is shown in a schematic perspective view of FIG. 3A. In FIG. 3A, three sets (six) of recording heads are formed on one substrate 1. A schematic cross-sectional view taken along the dot-dash-line 2D—2D of FIG. 3A corresponds to FIG. 2D.

Figure 2E:
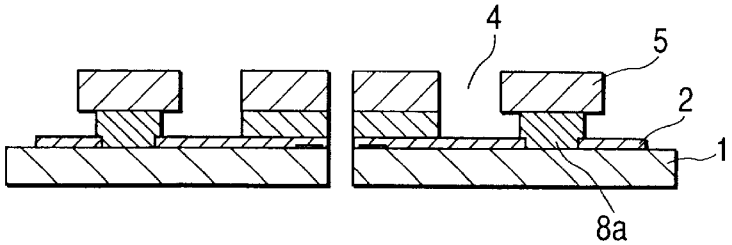
Figure 3B:
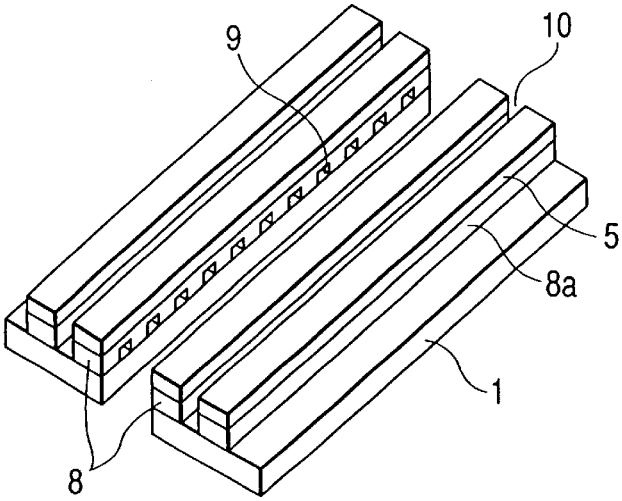

Referring to FIG. 2E, the center of an electrothermal converting member 14 in a row is cut with a diamond saw having a blade width of 1 mm to separate it to two heads. The center of the electrothermal converting member 14 corresponds to the dot-dash-line 2E—2E of FIG. 3A. On a portion of the supply opening 4 of the top plate is provided a beam (not shown). Namely, since the top plate 5 is not separated in the anterior and posterior area of the common ink chamber 10, the strength of the top plate 5 is maintained. The ink jet recording head during the production thereof, which corresponds to the head in the present step of FIG. 2E is shown in a schematic perspective view of FIG. 3B.

Figure 2F:
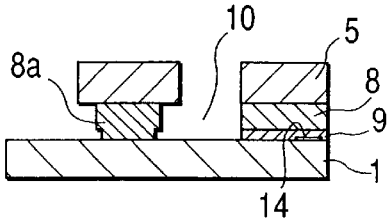

Referring to FIG. 2F, (ethyl cellosolve) was blown from above the top plate 5 to the ink jet recording head to remove the solid layer 2, so that a through-ink path was formed.

Figure 2G:
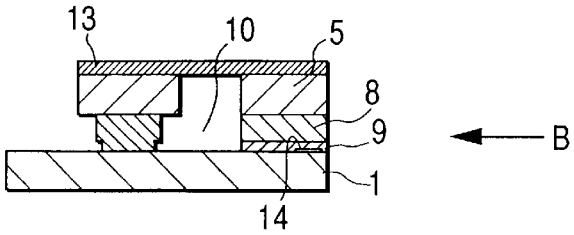
Figure 4:
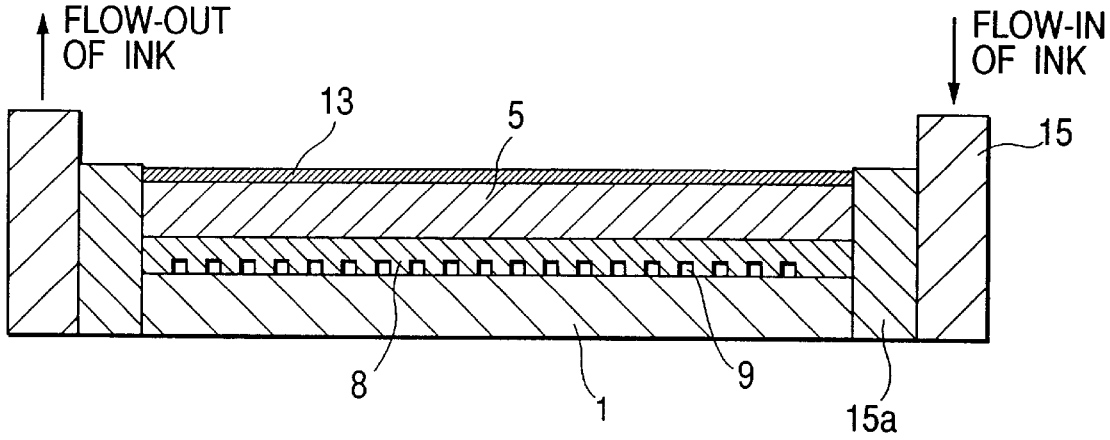
FIG. 4 is a schematic front view showing the ink jet recording head produced by the production steps of FIGS. 2A to 2G.

Referring to FIG. 2G, a covering plate was adhered to the upper surface of the top plate 3. Then, ink supply members 15 and 15*a* was attached to the supply openings 4 positioned at both ends of the common ink chamber 10 of the recording head. A schematic front view of the ink jet recording head produced by the present example, viewed from the arrow B, is FIG. 4.

EXAMPLE 2

FIGS. 5A to 5F are schematic cross-sectional views showing a production process steps of an ink jet recording head according to Example 2 of present invention. The main differences between Example 1 and Example 2 resides in that the top plate 5 has partially different thickness and the resin is not applied on the substrate 1 side in Example 2.

Figure 5A:
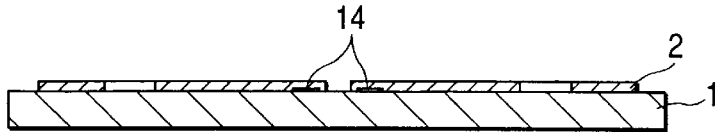
FIGS. 5A, 5B, 5C, 5D, 5E and 5F are schematic cross-sectional views showing a production process steps of an ink jet recording head according to Example 2 of present invention, and showing in turn the process steps from FIG. 1A.

FIG. 5A is substantially the same as FIG. 2A of Example 1.

Figure 5B:
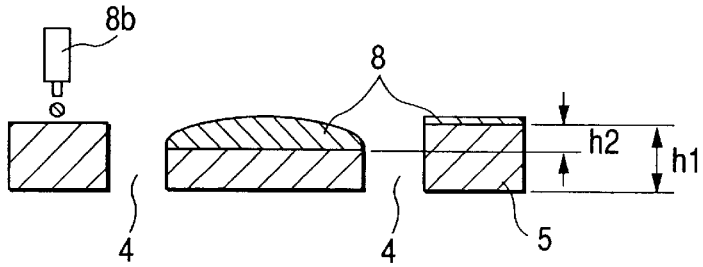

Referring to FIG. 5B, as a top plate 5, an aluminum plate having partially different thickness and subjected to ink resisting processing was used. The outer side thickness h1 of the top plate 5 was 2 mm and the difference h2 between the outer side and inner side thickness was 0.1 mm. A cold setting resin 8, which is the same material as that applied to the top plate 5 side in Example 1, was applied to the center portion of the top plate 5 having a width of 2.0 mm on the same conditions as in Example 1. Then, the same cold setting resin 8 was applied to both sides of the top plate 5 at a discharge pressure of 0.2 kg/cm$^2$. The resin can be thinly applied to the both sides of the top plate 5, unlike the center thereof.

FIGS. 5C to 5F are substantially the same as FIGS. 2D to 2G in Example 1.

EXAMPLE 3

FIGS. 6A to 6E are schematic cross-sectional views showing a production process steps of an ink jet recording head according to Example 3 of present invention. The main differences between Example 2 and Example 3 resides in that the upper portion of the top plate 5 has no opening in Example 3.

Figure 6A:
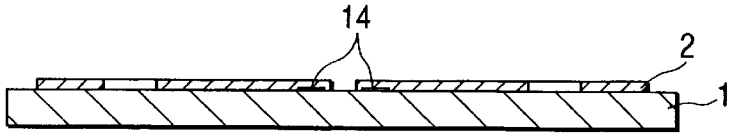
FIGS. 6A, 6B, 6C, 6D and 6E are schematic cross-sectional views showing a production process steps of an ink jet recording head according to Example 3 of present invention, and showing in turn the process steps from FIG. 1A.

FIG. 6A is substantially the same as FIG. 5A of Example 2.

Figure 6B:
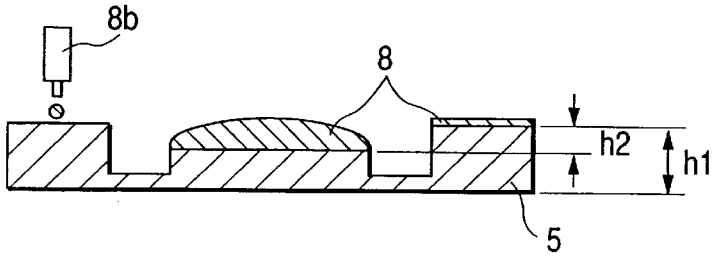

Referring to FIG. 6B, as a top plate 5, an aluminum plate subjected to ink resisting processing was used. The values of h1 and h2, other production conditions and the like are substantially the same as in Example 2.

Figure 5C:
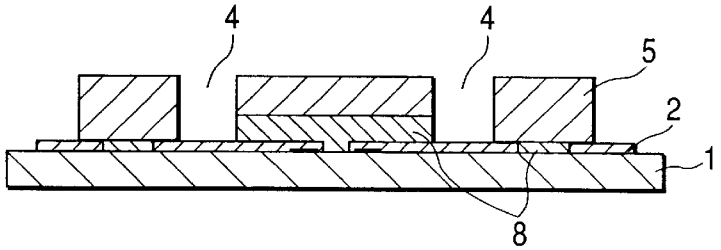
Figure 6C:
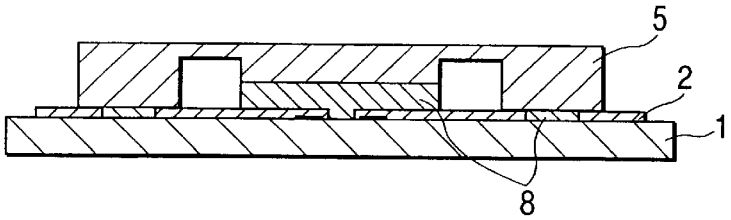

FIG. 6C is substantially the same as FIG. 5C of Example 2.

Figure 5D:
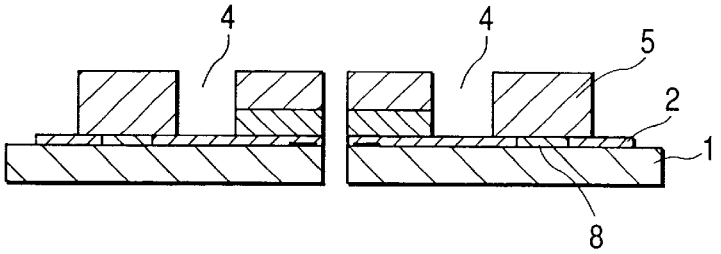
Figure 5E:
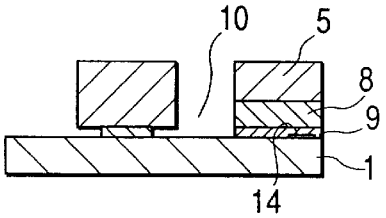
Figure 5F:
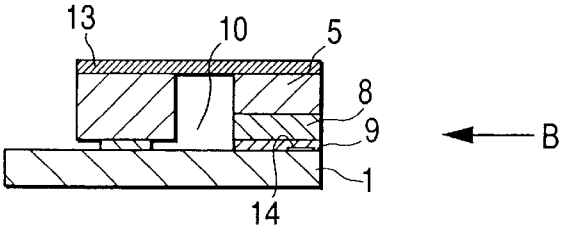
Figure 6D:
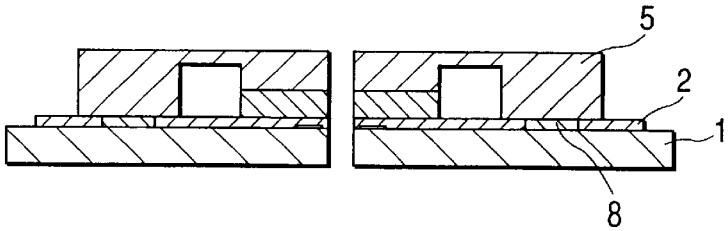

FIG. 6D is substantially the same as FIG. 5D of Example 2. In Example 3, there is no opening in the upper portion of the top plate 5. Accordingly, the structure of the recording head is more efficient in strength as compared to Example 2.

Figure 6E:
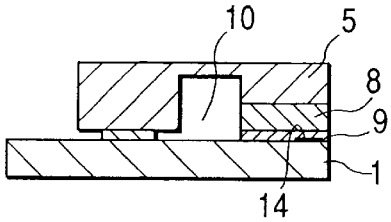

Referring to FIG. 6E, since the upper portion of the top plate has no opening, as described above, a removing liquid is blown from the side of the head (from a direction vertical to the paper) to remove the solid layer 2 thereby forming a through ink path. As described above, since the top plate 5 having no opening in Example 3 is used, adhesion of a covering plate to the top plate 5 is not needed.

EXAMPLE 4

FIGS. 7A to 7G are schematic cross-sectional view showing a production process steps of an ink jet recording head according to Example 4 of present invention.

Figure 7A:
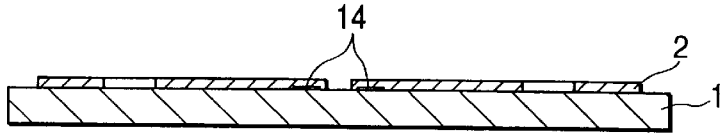
FIGS. 7A, 7B, 7C, 7D, 7E, 7F and 7G are schematic cross-sectional views showing a production process steps of an ink jet recording head according to Example 4 of present invention, and showing in turn the process steps from FIG. 1A.

FIG. 7A is substantially the same as FIG. 6A of Example 3.

Figure 7B:
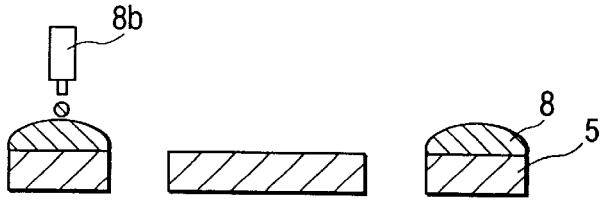

Referring to FIG. 7B, as a top plate 5, a 2 mm thick aluminum plate having a supply opening 4 and not subjected to ink resisting processing was used. A cold setting resin 8 was applied to both side portions of the top plate 5 having a width of 1.2 mm, from a dispenser 8*b*, with the surface of the top plate 5 directed upwardly. This cold setting resin 8 is a mixture of 100 parts by weight of "EPIKOTE 828" produced by Yuka Shell Epoxy Co. Ltd., and 50 parts by weight of "FUJICURE-6010" produced by Fuji Kasei Kogyo Co. Ltd. This cold setting resin 8 was coated by a needle G21 with a discharge pressure 2.0 Kg/cm$^2$, coating speed 30 mm/sec and distance 0.1 mm between the top plate and the needle.

The cold setting resin 8 is maintained in a convex shape by the surface tension at the edges of the top plate. The resin 8 was half set at 75° C. for 1 hour under vacuum.

Figure 7C:
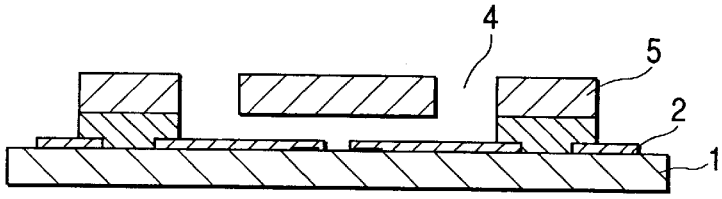

Referring to FIG. 7C, the top plate 5 was connected to the substrate 1, with the surface of the top plate 5 directed downwardly. In this connection, since the resin 8 is in a half set condition, both the top plate 5 and the substrate 1 can be connected to each other at a comparatively small pressure. As the result an about 100 $\mu$m thick resist layer is formed.

Figure 7D:
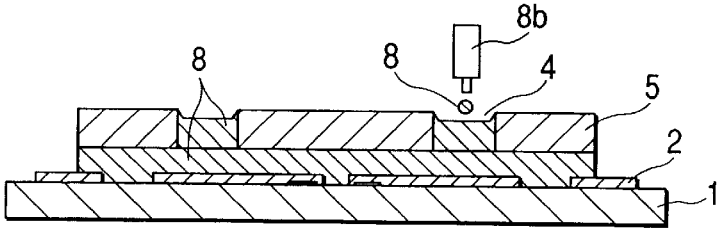
Figure 7E:
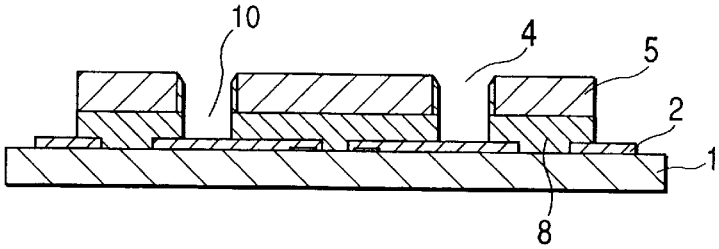

Referring to FIG. 7D, a common ink chamber 10 formation portion was filled with the same cold setting resin 8 as mentioned above from the ink supply opening 4, and the resin 8 was set. The detailed procedure of such step was as follows. First, the resin 8 was introduced to a level below the upper surface of the top plate 5. Then a vacuum debubbling process was performed at the normal temperature for an hour. After that it was heated at 30° C. for 24 hours, and 120° C. for 1 hour, whereby the resin 8 was fully set. Then, an additional resin 8 was introduced to a level above the ink supply opening 4 and heated at 60° C. for 6 hours, whereby its resin 8 was half set. The reason why no full setting of the resin is effected is to prevent bending of the substrate due to setting shrinkage.

Referring to FIG. 7E, the resin 8 near the ink supply opening 8 was abraded to the solid layer 8 with a diamond saw having a width narrow than the supply port 4, thereby forming an ink chamber 10. As results, the resin covering the side of the top plate functions as an ink resistive layer. Then, the obtained structure was subjected to heating at 120° C. for 1 hour so that the half set resin formed in the previous step of FIG. 7D was fully set. In this heating step, even if the resin is heated at 120° C., the substrate is not warped or bent because of the small amount of resin to be fully set.

Figure 7F:
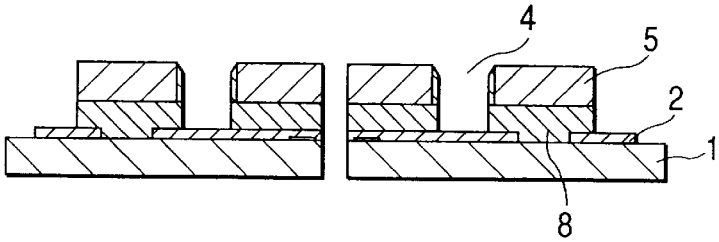

Referring to FIG. 7F, the center of an electrothermal converting member in a row was cut with the diamond saw, thereby to separate it to two heads.

Figure 7G:
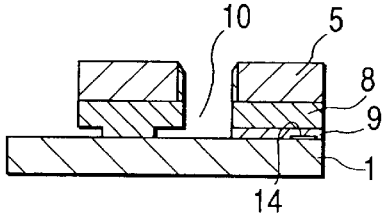
Figure 8A:
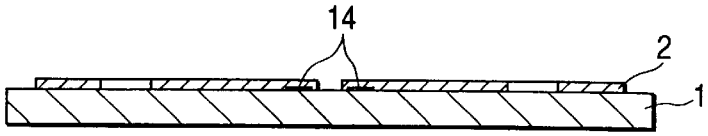
FIGS. 8A, 8B, 8C, 8D, 8E, 8F and 8G are schematic cross-sectional views showing a production process steps of an ink jet recording head according to Example 5 of present invention, and showing in turn the process steps from FIG. 1A.
Figure 8B:
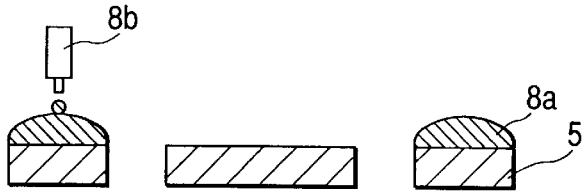
Figure 8C:
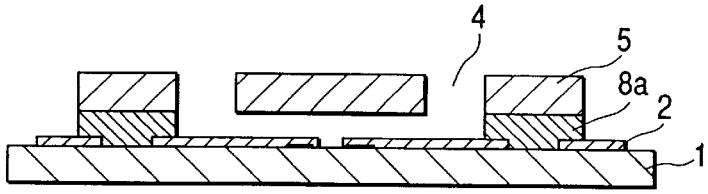
Figure 8D:
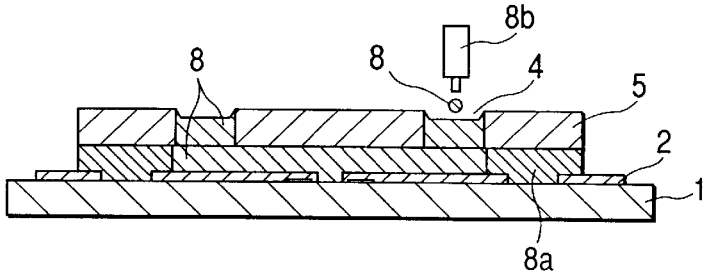
Figure 8E:
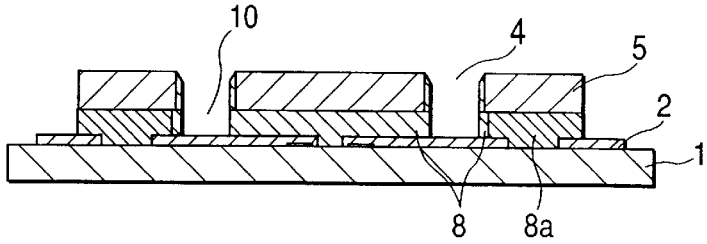
Figure 8F:
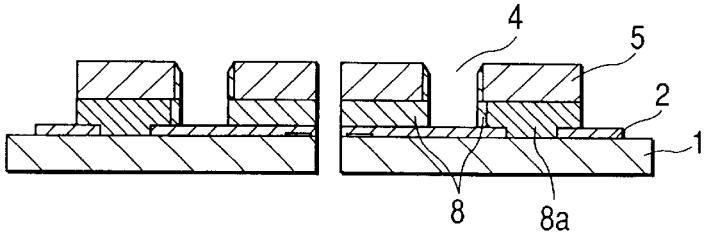
Figure 8G:
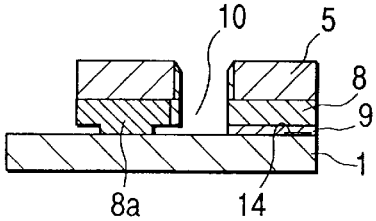

Referring to FIG. 7G, (ethyl sellosolve) was blown from above the top plate 5 to the ink jet recording head to remove the solid layer 2, so that a through-ink path was formed.

EXAMPLE 5

FIGS. 8A to 8G are schematic cross-sectional views showing a production process steps of an ink jet recording head according to Example 5 of present invention. The main difference between Example 4 and Example 5 resides in that the resin applied to a portion on the top plate side is different from the resin introduced to fill the common ink chamber formation portion. It is preferable that the former resin has relatively high viscosity to form a space, and on the other hand, the latter resin has relatively low viscosity so that it reaches minute portions having high ink resisting properties.

In this embodiment, as the filler resin, a viscosity-raised resin 8*a* prefared by using the same resin 8 as cold setting curable resin used in the fourth embodiment and mixing fillers by 30 wt % into the same cold setting curable resin as the coating resin is used.

What is claimed is:

1. A method of producing an ink jet recording head comprising the steps of:

forming a solid layer in a pattern on a portion of a substrate, which portion communicates with a discharge port through which an ink is discharged, the solid layer corresponding to an ink path that is being formed and which has an energy generator which generates energy that discharges the ink from the discharge port;

providing a non-cured material on a top plate to form a wall member of the ink path such that the non-cured material is held by surface tension at a side end of the top plate;

causing the substrate and the top plate to approach each other so that the non-cured material covers the solid layer; and removing the solid layer to form the ink path.

2. A method of producing an ink jet recording head according to claim 1, wherein in said forming step the surface of the top plate faces upward, and in said causing step the surface of the top plate faces downward.

3. A method of producing an ink jet recording head according to claim 1, wherein said providing step further comprises the step of, after the providing of the non-cured material on the top plate, heat treating the non-cured material to be half set.

4. A method of producing an ink jet recording head according to claim 1, wherein said providing step further comprises the step of, after the providing of the non-cured material on the top plate, placing the non-cured material under a reduced pressure.

5. A method of producing an ink jet recording head according to claim 1, further comprising a step of fully setting the non-cured material between said causing step and said removing step.

6. A method of producing an ink jet recording head according to claim 5, further comprising the step of performing a cutting process between said fully setting step and said removing step to obtain a plurality of ink jet recording heads.

7. A method of producing an ink jet recording head according to claim 1, wherein said removing step precedes said providing step.

8. A method of producing an ink jet recording head according to claim 1, wherein said providing step precedes said removing step.

9. A method of producing an ink jet recording head according to claim 1, wherein said removing step and said providing step are performed simultaneously.

10. A method of producing an ink jet recording head according to claim 1, wherein said ink path includes a plurality of ink flow paths each provided with an associated said energy generator, and a common ink chamber for storing ink which is supplied to said plurality of ink flow paths.

11. A method of producing an ink jet recording head according to claim 10, wherein a portion of said top plate, which corresponds to said plurality of ink flow paths, is thinner than other portions, and the non-cured material is provided on the thinner portion of the top plate in the providing step.

12. A method of producing an ink jet recording head according to claim 1, further comprising the step of forming said common ink chamber by an abrading process.

13. An ink jet recording head produced by the production method of claim 1.

* * * * *

UNITED STATES PATENT AND TRADEMARK OFFICE

CERTIFICATE OF CORRECTION

PATENT NO. : 6,241,335 B1
DATED : June 5, 2001
INVENTOR(S) : Toshio Suzuki

It is certified that error appears in the above-identified patent and that said Letters Patent is hereby corrected as shown below:

Column 1,
Line 66, "correspond an ink path," should read -- correspond, on an ink path --.

Column 3,
Line 46, "rose" should read -- rows --; and
Line 47, "acts" should read -- acts as --.

Column 5,
Line 3, "was" should read -- were --; and
Line 65, "view" should read -- views --.

Column 6,
Line 24, "the" should read -- a --; and
Line 52, "ethyl sellosolve" should read -- ethyl cellosolve --.

Column 7,
Line 2, "prefared" should read -- prepared --.

Signed and Sealed this

Second Day of April, 2002

*Attest:*

*Attesting Officer*

JAMES E. ROGAN
*Director of the United States Patent and Trademark Office*